United States Patent [19]

DeVierno

[11] 4,298,157

[45] Nov. 3, 1981

[54] SEPARATOR AND STORAGE BOX

[76] Inventor: Richard A. DeVierno, 9508 E. Bexhill Dr., Kensington, Md. 20795

[21] Appl. No.: 102,615

[22] Filed: Dec. 11, 1979

[51] Int. Cl.[3] ..... B65D 85/30; B65D 5/26

[52] U.S. Cl. ..... 229/35; 206/311; 206/216; 209/702

[58] Field of Search ..... 209/702, 703; 206/311, 206/557; 229/35

[56] References Cited

U.S. PATENT DOCUMENTS

| | | | |
|---|---|---|---|
| 1,125,847 | 1/1915 | Hamparey | 206/216 X |
| 1,190,797 | 7/1916 | Powell | 229/35 |
| 1,623,547 | 4/1927 | Neuman | 229/35 X |
| 2,563,145 | 8/1951 | Winkler | 229/35 X |
| 2,573,379 | 10/1951 | Acker | 229/35 |
| 2,967,654 | 1/1961 | Palmer | 229/35 |
| 3,074,611 | 1/1963 | Tolaas | 229/9 |
| 3,747,757 | 7/1973 | Kalthoff | 209/703 |
| 4,063,645 | 12/1977 | Canterman et al. | 209/702 |
| 4,101,028 | 7/1978 | Woolbright | 206/311 |
| 4,173,655 | 11/1979 | Capo | 229/35 X |

*Primary Examiner*—Davis T. Moorhead

*Attorney, Agent, or Firm*—Shoemaker and Mattare, Ltd.

[57] ABSTRACT

A box for separating articles, such as seeds, small stones, or the like, from other materials, such as leaves, flowers, sand, soil, or the like, is formed from an integral blank which can be easily folded into a set-up configuration. The box can also be folded into a flat envelope or storage container which is conveniently carried in a pocket, such as a shirt pocket, or the like.

1 Claim, 11 Drawing Figures

SEPARATOR AND STORAGE BOX

BACKGROUND OF THE INVENTION

The present invention relates in general to containers, and, more particularly, to a portable, collapsible container which can be used to separate material.

In agriculture and plant culture, it is often necessary to separate seeds from a mass of material which also contains leaves and/or flowers, or the like, or to separate stones, pebbles and dirt or rocks from soil or sand. Often, the remnants of this mass are saved for further processing. Heretofore, this remaining mass had to be transferred from a separator to a separate container to effect such storage, thus necessitating the use of at least two devices. An example of such sorting only devices is shown in U.S. Pat. No. 3,747,756.

This problem has engendered devices such as the device disclosed in U.S. Pat. No. 4,063,645, but these devices are cumbersome and are not at all suited for carrying on the person. Furthermore, these devices are difficult and expensive to manufacture.

It is noted that none of the prior art devices include a safety feature in a hand-held manual separator which permits discharge of all or none of the separated commodity as desired. Thus, inspection and rework is not expeditious.

Accordingly, there is need for a container which can be used as a sorting device and as a storage device which is easily transportable on the person of the user.

SUMMARY OF THE INVENTION

The device embodying the teachings of the present invention can separate small items capable of basically rolling or tumbling from other material of a composition that does not roll or tumble. It can be used as a storage container and can be easily carried on the person of the user.

The device includes a trapezoidal open-topped box formed from a blank by folding, and the material to be separated is dropped into the box through the open top thereof. The box is jiggled and moved while tilted downwardly. The material contacts the sides of the box and the converging nature of those sides increases the resistance to movement of parts of the material while the remaining parts, such as seeds, stones or the like, easily roll or migrate down toward the narrow end of the box. Once the separation is complete, the seeds or stones now at the narrow bottom end of the box may be discharged through the hinged flap leaving only the flowers, leaves or soil in the box.

The box has at least one transverse foldline and can be closed by folding to store the remaining material therein. The trapezoidal box forms a trapezoidal container which easily fits into a user's pocket, such as a shirt pocket, or the like.

The folded configuration has overlapping panels so that the container is securely closed. Furthermore, the horizontal foldline or lines in the work surface tend to aid in the separation process. Such lines or shallow grooves do not prevent items that roll or tumble from gravitating to the lower end of the box, yet tend to catch or stop items that can only slide.

This hand-held sorting apparatus benefits from the ability to transmit vibrations into the hand as soon as the seeds or stones begin to move. This can eliminate too much shaking, which tends to drive all of the material to the bottom of the box.

The device of the present invention is easily manufactured in the form of a unitary foldable blank which can also be punched out during manufacture, if so desired.

The device of the present invention has an end flap which serves as a safety feature in that material can be discharged or retained depending upon whether the end flap is up or down. This allows the results of the separation to be inspected while still on the same work surface, and if desired, be partly or totally remixed by reversing the tilt of the box, or by use of hand or instrument.

The device is quickly and easily set up, and folded into a readily portable container.

OBJECTS OF THE INVENTION

The main object of the present invention is to separate seeds, stones, or the like from other material such as leaves, soil, or the like.

Another object of the present invention is to use the same device which separates seeds, stones, or the like from other material such as leaves, soil, or the like as an easily portable storage container.

Another object of the present invention is to provide a small portable separator and storage box that can be carried in the pocket.

Yet another object of the present invention is to provide an easily manufactured separating and storage device for use in home gardening, nurseries, or the like.

Still another object of the present invention is to provide a hand-held manual separator.

A further object of the present invention is to provide a hand-held shakable sorter which is designed to reduce the possibility of overshaking.

Yet a further object of the present invention is to provide a hand-held manual sorter with a safety feature which permits inspection of the material contained therein.

These together with other objects and advantages which will become subsequently apparent reside in the details of construction and operation as more fully hereinafter described and claimed, reference being had to the accompanying drawings forming part hereof, wherein like reference numerals refer to like parts throughout.

DETAILED DESCRIPTION OF THE INVENTION

Figure 1:
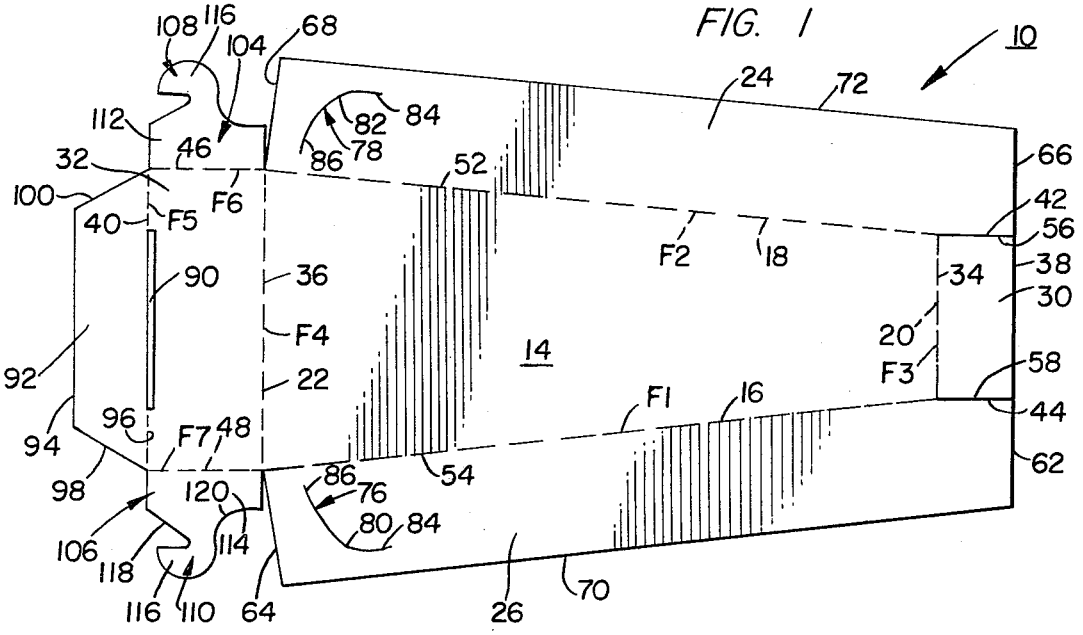
FIG. 1 is a plan view of an integral blank used to form the separator and container embodying the teachings of the present invention.
Figure 6:
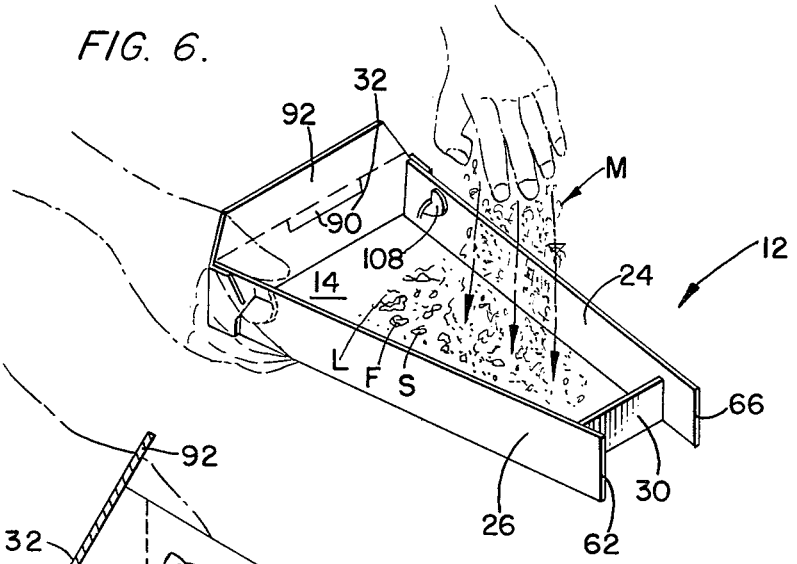
FIGS. 6–8 show the steps in using a separator formed from the FIG. 1 blank.

Shown in FIG. 1 is a blank 10 which can be folded into an open top box configuration 12 shown in FIG. 6.

The blank 10 includes a trapezoidal body 14 having non-parallel side edges 16 and 18 and parallel end edges 20 and 22 each defined by foldlines $F_1$, $F_2$, $F_3$ and $F_4$, respectively.

Integrally and foldably attached to the body 14 via the foldlines $F_1$ and $F_2$, respectively, are polygonal side panels 24 and 26 and polygonal end panels 30 and 32 via foldlines $F_3$ and $F_4$, respectively. The end panels are essentially rectangular having inner side edges 34 and 36 attached via the foldlines to the base and outer side edges 38 and 40 remotely located from the inner side edges. The end panels also have end edges 42–48 as shown in FIG. 1.

The side panels are slightly pentagonal in shape, having inner side edges 52 and 54 integrally and foldably attached to the base and inner end edges 56 and 58 adjacent, but not attached to, the end edges 42 and 44 of the end panel 30. The side panels also include end edges 62, 64, 66 and 68 and outer side edges 70 and 72 which are remote from foldlines $F_1$ and $F_2$, respectively.

Slots 76 and 78 are defined in the side panels to have arcuate portions 80 and 82 with straight portions 84 and 86 tangentially intersecting the arcuate portions. The arcuate portions are positioned to be concave with respect to the foldlines $F_1$ and $F_2$, respectively, and to be located adjacent the end edges 64 and 68, respectively. As shown in FIG. 1, one straight portion of each of the arcuate slots is asymptotic with the end flap side edges, while the other straight portion of each slot appears to be on a line which intersects the end edges.

As shown in FIG. 1, rectangular open slot 90 is defined in end panel 32 to have one side edge thereof defined by side edge 40 of the end panel and the other side edge thereof located inwardly of the panel toward the foldline $F_4$. The slot end edges are spaced inwardly of the end panel from the panel end edges.

A trapezoidal end flap 92 has parallel side edges 94 and 96, with edge 96 integrally and foldably connected to the end panel 32 via a foldline $F_5$. The end flap 92 has non-parallel end edges 98 and 100 converging outwardly from the end panel 32.

A pair of end panel tongue flaps 104 and 106 are integrally and foldably attached to the end panel end edges 46 and 48, respectively, via foldlines $F_6$ and $F_7$, respectively, and include hook-like tongue tabs 108 and 110 on the outer ends thereof. Each flap 104 and 106 has a polygonal base 112 and 114, respectively, with the tongue tabs on the outer edges of the bases as shown in FIG. 1. The tongue tabs each has a head 116 connected to the base by a V-shaped edge 118 and an arcuate edge 120.

Set-up of the box 12 from the blank 10 is accomplished by folding the end panel 30 upwardly (that is, out of the plane of the paper) 90° from the FIG. 1 position, then folding the end panel 32 upwardly 90° from the FIG. 1 position. The tongue flaps 104 and 106 are then folded 90° toward the set-up end panel 30. The side panels 24 and 26 are folded upwardly 90° from the FIG. 1 position, and the tongue tabs 108 and 110 are inserted through the slots 76 and 78 from inside the box to the outside. The end flap 92 can be left up as shown in FIG. 6, or folded downwardly toward the body 14, if so desired.

Figure 2:
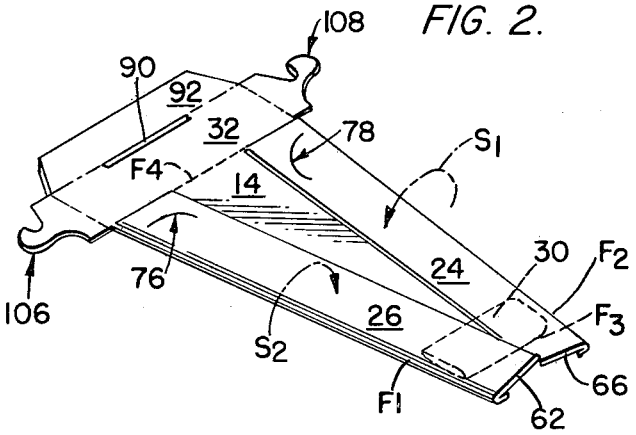
FIGS. 2–5 show the steps used in forming a container from the FIG. 1 blank.
Figure 3:
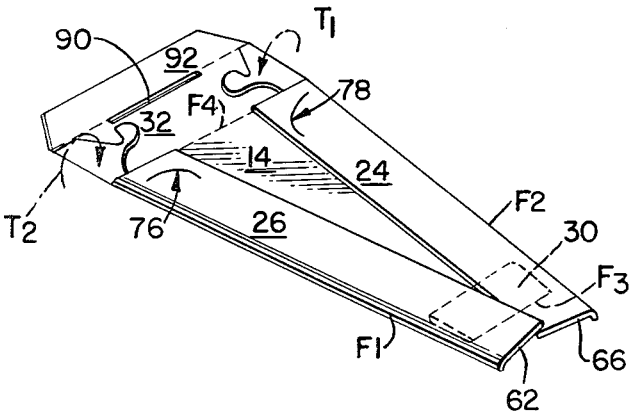
Figure 4:
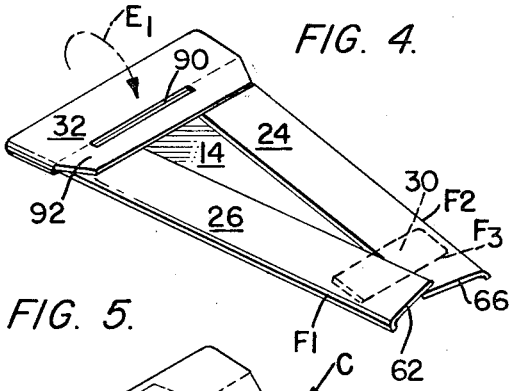
Figure 5:
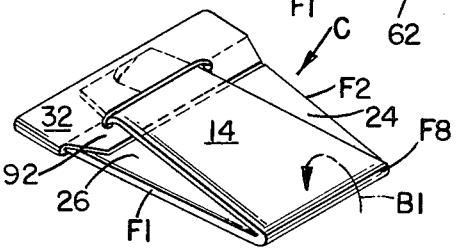

A container C is shown in FIG. 5, and is formed from the blank 10 according to the steps shown in FIGS. 2–6. The end panel 30 is first folded 180° upwardly from the FIG. 1 position, then the side panels are rotated 180° upwardly from the FIG. 1 position as indicated by arrows $S_1$ and $S_2$ is FIG. 2. The tongue flaps are rotated upwardly 180° as shown in FIG. 3 by arrows $T_1$ and $T_2$, and the end panel 32 is then rotated 180° upwardly as shown in FIG. 4 by arrow $E_1$. The base and end panels are then folded upwardly 180° as shown in FIG. 5 by arrow $B_1$. A foldline $F_8$ can be defined in the blank to extend transversely of the side panels 24 and 26 and the base 14 to make the last-mentioned fold $B_1$ easier. The ends of the side panels are inserted into the slot 90 which has a longitudinal extent selected to establish a snug fit with such side panel ends, and the container C is thus defined.

Figure 10:
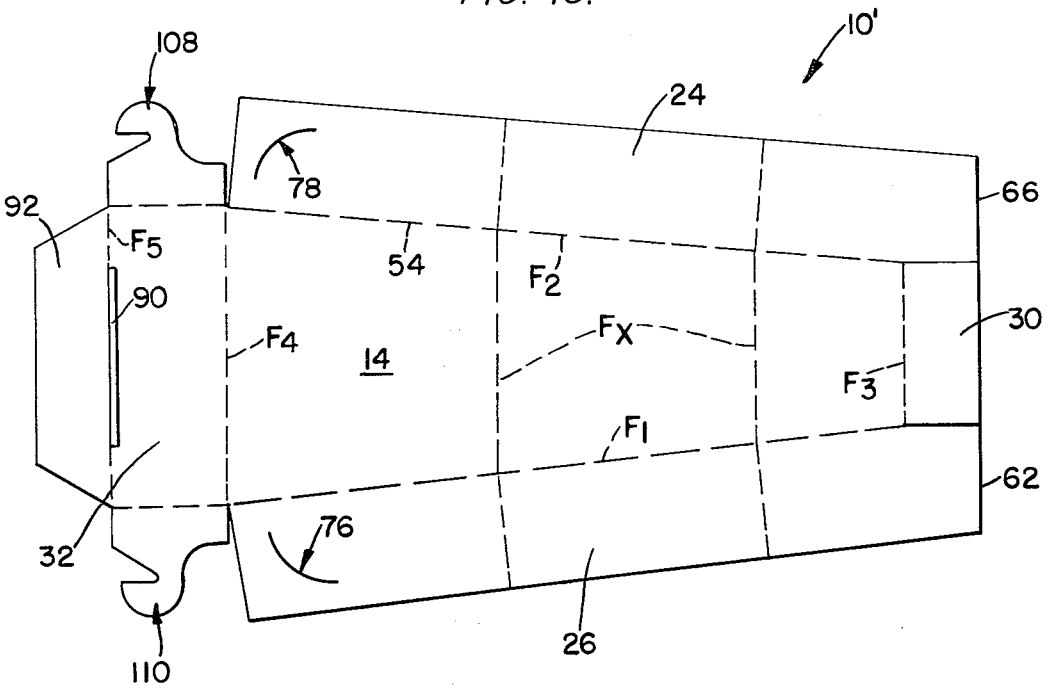
FIG. 10 is a plan view of an integral blank used to define another form of the separator and container embodying the teachings of the present invention.
Figure 11:
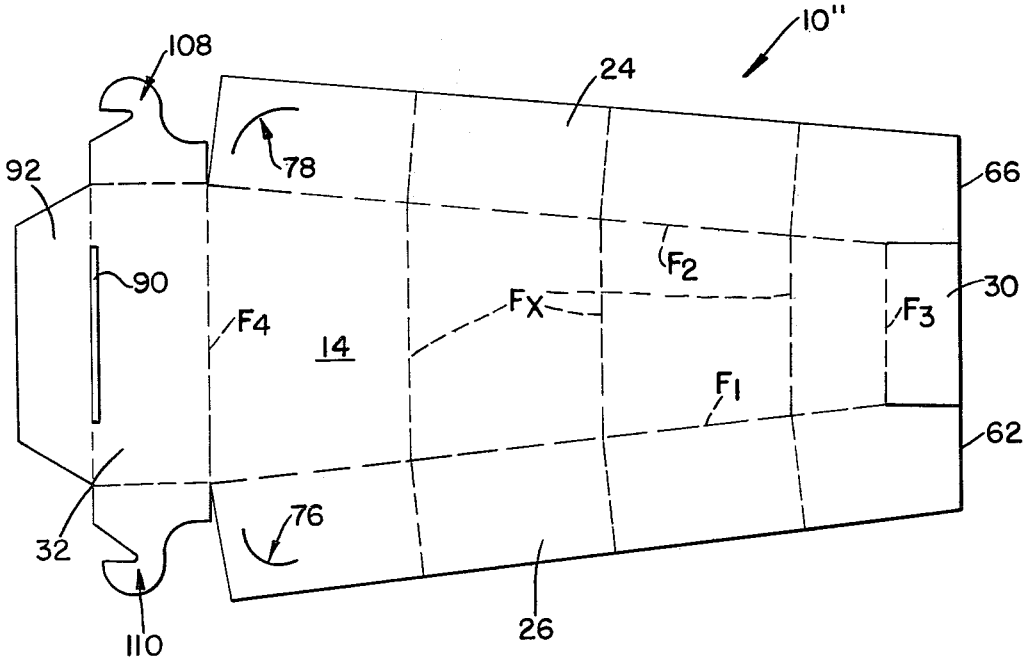
FIG. 11 is a plan view of an integral blank used to define another form of the separator and container embodying the teachings of the present invention.

As shown in FIGS. 10 and 11, several folds $F_x$ similar to $F_8$ may be defined in the blank so that the container can be made smaller by folding it over a plurality of times before insertion into slot 90. While FIG. 10 shows a blank 10' having two foldlines $F_x$ and FIG. 11 shows a blank 10'' having three foldlines $F_x$, it is noted that any number of foldlines can be used depending on how small the final container is desired to be. The blank 10'' can be folded to define two separate, sealed compartments so that two different materials may be stored and kept separate. The blank 10' can form three compartments, of which one is totally sealed, while blank 10'' can form two totally sealed compartments, as above-discussed, as well as two other compartments.

Figure 7:
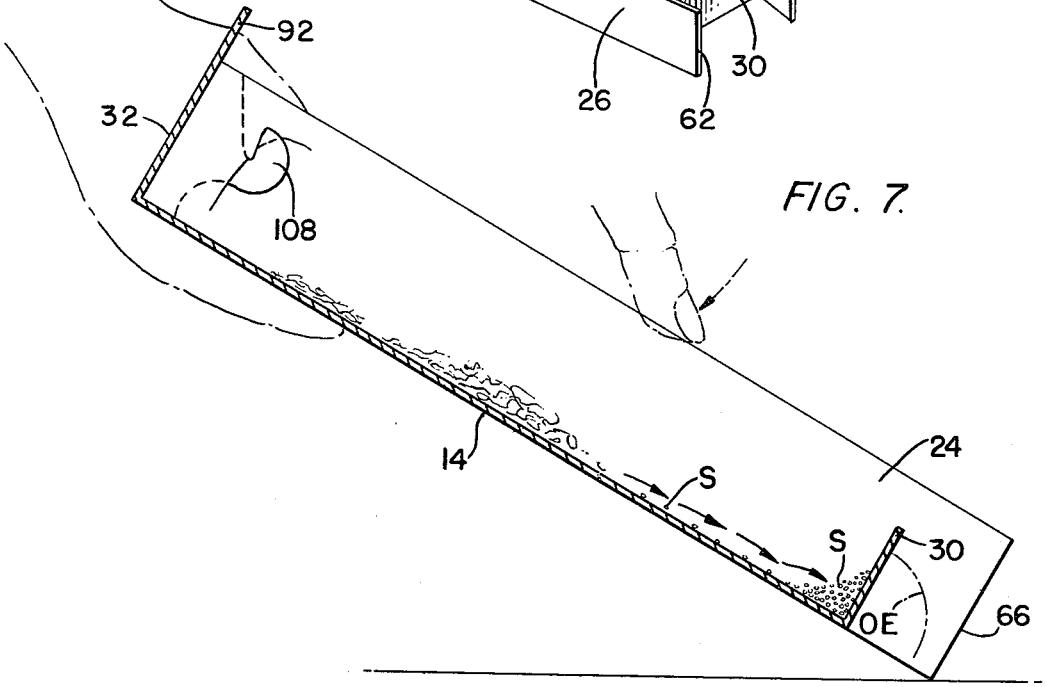
Figure 8:
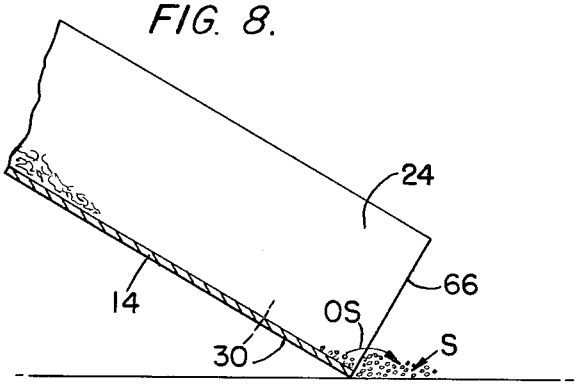

One use of the set-up box is shown in FIGS. 6–8, wherein seeds S are separated from flowers F and/or leaves L. As shown in FIG. 6, the box is held in one hand in a position which is slightly downwardly tilted away from the user, as best shown in FIG. 7. A mass M of material containing the seeds is crumbled into the box as shown in FIG. 6. The seeds will roll toward the end 30, and the box can be jiggled slightly to assist in this downward migration of seeds during the crumbling procedure. The mass of material in the box can be stirred gently with the hand after the material has all been crumbled into the box, or can be stirred by an instrument, if so desired, to further assist the separation of the seeds from the rest of the material. The end panel 30 can be held closed by exerting inward pressure on the side panels 24 and 26 during this initial crumbling and separating procedure, however, end panel 30 stays closed by itself due to tension created by the converging side panels 24 and 26.

Once the seeds are separated, the bottom panel 30 is opened as indicated in FIG. 7 by arrow OE, and the seeds removed from the box by dumping, or the like, as indicated by arrow OS in FIG. 8. The end panel 30 can be held open by exerting inward pressure on the side panels 24 and 26 during this emptying procedure, however, end panel 30 stays open by itself when opened to be a horizontal continuation of body 14 due to side panels 24 and 26 converging over its edges.

The box can be folded into the FIG. 5 container once some or all of the seeds are removed to save the material left in the box by simply folding the end flap back upwardly into overlapping position with the box, freeing the tongue flaps from the slots, folding the side panels as shown in FIG. 2, then following the above-discussed procedure to define container C which holds the remnants of the mass M in the box.

Figure 9:
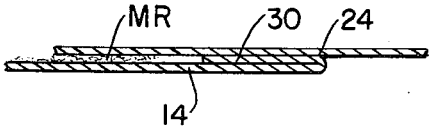
FIG. 9 is an elevation view of the end of a container formed from the FIG. 1 blank.

A portion of the folded container is shown in FIG. 9 wherein some material MR remains in the container and the end panel 30 is folded with the side panel 24 overlapping that folded end panel. The folded container with the stored remnants MR can easily be inserted into a user's pocket and therein stored for easy accessibility.

Preferably, the blank is formed of cardboard, or chipboard, and the set-up procedure includes rotating the panels 90° into an upright position wherein an essentially right angle is formed about the appropriate foldline. It is noted that the preferable construction for the apparatus depends upon the intended usage. For example, separating pebbles from sand would require a heavier grade cardboard than separating seeds from flower buds.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. An integral foldable blank comprising:

a trapezoidal body having non-parallel side edges and parallel end edges;

a first rectangular end panel having a pair of end edges and a pair of side edges and being foldably attached to one of said body end edges by a foldline defined along one of said first end panel end edges;

a second rectangular end panel having a pair of end edges and a pair of side edges and being foldably attached to another of said body end edges by a foldline defined along one of said end panel side edges, said second end panel being larger than said first end panel and having an open rectangular slot defined therein on another second end panel side edge, said slot having a length larger than the length of said first end panel so that said first end panel can be accommodated therein;

a pair of equal sized polygonal side panels each having a pair of end edges and a pair of side edges and each being foldably attached to one of said body side edges by a foldline defined along one of said panel side edges, said side panels converging toward said first end panel and each having an arcuate slot defined therein adjacent one of said side panel end edges, each of said slots having one end adjacent a foldline and having another end oriented essentially parallel with another of said side panel side edges;

a third end flap having a pair of parallel side edges integrally and being attached to said another second end panel side edge along one of said third end flap parallel side edges;

a foldline extending transversely across said body and said side panels so said body and said side panels can be folded to insert said first end panel into said rectangular slot to define a closed pouch; and a pair of tongues each foldably attached to a second end panel end edge near one of said arcuate slots, each of said tongues including a base having one edge foldably attached to a second end panel end edge, a pair of parallel side edges each being colinear with said first end panel end edges and an arcuate tongue tab on another edge thereof, said tongue tabs extending outwardly from said bases and being colinear with each other.

* * * * *